US005243724A

United States Patent [19]

Barnes

[11] Patent Number: 5,243,724

[45] Date of Patent: Sep. 14, 1993

[54] MULTI-PURPOSE BABY WRAP

[76] Inventor: Evelyn R. Barnes, 3760 Holy Cross Way, Decatur, Ga. 30034

[21] Appl. No.: 691,219

[22] Filed: Apr. 25, 1991

[51] Int. Cl.[5] ..... A47G 9/00; A41B 13/06

[52] U.S. Cl. ..... 5/482; 2/69.5; 297/465; 297/219.12; 5/494; 224/159

[58] Field of Search ..... 2/69, 69.5; 224/158, 224/159, 160; 297/467, 465, 219; 5/494, 482

[56] References Cited

U.S. PATENT DOCUMENTS

| | | | |
|---|---|---|---|
| 2,227,751 | 1/1941 | Idelman | 2/69.5 |
| 2,550,851 | 5/1951 | Nichols | 224/159 |
| 2,701,885 | 2/1955 | Turco | 2/69.5 |
| 3,034,132 | 5/1962 | Landsberger et al. | 2/69.5 |
| 3,197,100 | 7/1965 | Thompson | 224/160 |
| 3,229,873 | 1/1966 | Hershman | 224/160 |
| 3,412,407 | 11/1968 | Key | 2/69.5 |
| 3,477,065 | 11/1969 | Hoover | 2/69.5 |
| 3,962,738 | 6/1976 | Menditto | 5/494 |
| 4,142,264 | 3/1979 | Whiting | 2/69.5 |
| 4,254,900 | 3/1981 | Wheeler | 224/158 |
| 4,478,453 | 10/1984 | Schutz | 297/219 |
| 4,897,885 | 2/1990 | Lunt | 2/69.5 |
| 4,986,438 | 1/1991 | Linday | 224/160 |
| 4,993,090 | 2/1991 | Ranalli | 2/69 |

FOREIGN PATENT DOCUMENTS

| | | | |
|---|---|---|---|
| 2342188 | 9/1977 | France | 297/467 |

*Primary Examiner*—Eric K. Nicholson
*Attorney, Agent, or Firm*—Harry I. Leon; Vivian L. Steadman

[57] ABSTRACT

A multi-purpose baby wrap which converts to a blanket, a bunting, a pad or a carrier sling. The wrap comprises two major parts: a full sized baby blanket and a large, detachable, bifurcated pocket. The pocket covers the lower half of the blanket and is sized to fit children from birth to about two years, with the pocket covering the child's legs and torso up to the waist. A baby's diaper may be changed without removing the baby from the wrap by simply unfastening the bottom and sides of the pocket and lifting it to expose the lower half of the baby. For use of the wrap as a bunting, the baby is placed feet first in the pocket; the blanket is then rolled around the baby and secured snugly about his or her midriff with one or two short straps. With the blanket so secured, the apparatus in plan view presents the appearance of a rectangle. At each corner of this rectangle, a fastener is provided for attaching a pair of elongated straps to the wrap. Crossed in the center, these elongated straps, with the wrap, form a sling for carrying the baby. Alternately, for transport of an infant in a car seat or stroller, the wrap is equipped with overlapping openings formed in the blanket and in the pocket, respectively. These openings allow a safety belt for the car seat or stroller to be inserted between the baby's legs.

5 Claims, 2 Drawing Sheets

MULTI-PURPOSE BABY WRAP

BACKGROUND OF THE INVENTION

The invention is a multipurpose wrap for the care of a baby. The wrap can serve as a blanket in which to wrap the baby, as a pad to use in a car seat or stroller, and as a sling for carrying an infant.

Many inventors in the past have recognized the need for a multi-functional baby care apparatus to reduce the pieces and cost of equipment needed for infant care. One of the most recent apparatus of this nature was disclosed by Aranow, U.S. Pat. No. 4,723,300. Aranow described a convertible tote bag usable as a blanket and baby bag. Powers, U.S. Pat. No. Des. 300,784, had a similar idea. One of the earliest combination baby care apparatus was disclosed by Junghans, U.S. Pat. No. 2,538,420. Junghans taught a service blanket for infant care that converted to a bag carrier.

A similar trend toward multi-purpose blankets directed at adult use also exists. Vacheron, U.S. Pat. No. 2,442,105, Lalick, U.S. Pat. No. 2,870,464, and Walsh, U.S. Pat. No. 2,344,010, disclosed combination blanket and bags that were primarily designed for adults relaxing at the beach or enjoying a spectator sport.

SUMMARY

It is an object of the present invention to provide an inexpensive multi-purpose wrap for the care of a baby. The wrap can be used as a baby blanket, a bunting, a sling carrier, or a pad for a car seat or buggy.

It is a further object of this invention to provide an apparatus which can be used not only to perform all of the functions normally performed by the components listed hereinabove but also to perform these functions with ease and possibly better than do the individual components it replaces.

The multi-purpose wrap comprises a full-sized baby blanket, the lower half of which is covered with a large pocket which can be detached, in whole or in part, from the blanket. Wraps in a variety of sizes are provided. For newborns, the wrap is sized so that the blanket measures about 30 inches by 30 inches. For larger babies, the blanket measures, by way of example, 36 inches in height by 42 inches in width. The wrap is appropriately sized for a particular child when the pocket covers him approximately up to the waist when his legs are placed feet first into the pocket.

To use the wrap, a child's legs and lower torso are placed in the pocket and then the blanket, together with the pocket, is wrapped around the child's body like a receiving blanket. A short strap is provided to secure the wrap snugly about the baby's midriff, making the baby feel warm and secure in the blanket. Once this short strap is secured, the wrap in plan view has a generally rectangular shape. Proximate each corner of the rectangular shape, a fastener is provided to which one of two elongated straps may be attached. These elongated straps are crossed in the center and, with the wrap, form a sling for carrying the baby either by the shoulder or across the body.

To facilitate changing a baby's diapers, the pocket along its bottom and sides is secured to the blanket with detachable fasteners such as snaps, strips of VELCRO® or of other tape having intermeshing faces which can be fastened to each other. With the wrap according to the present invention, one can change a baby's diapers without removing the infant from the pocket. The caregiver simply unfastens the lower portions of the pocket so that they can be lifted up exposing the lower half of the baby.

DESCRIPTION OF THE PREFERRED EMBODIMENT

Figure 1:
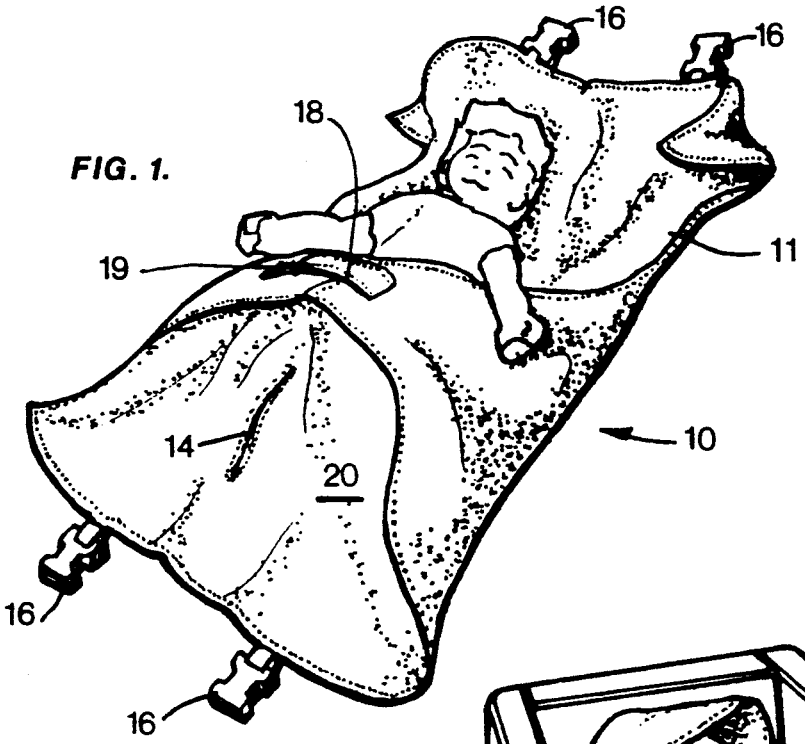
FIG. 1. is a perspective view of the multi-purpose wrap according to the present invention when used in the bunting configuration.

Referring to the drawings, there is shown in FIGS. 1 through 4 a multi-purpose baby care apparatus which is indicated generally by the numeral 10. The apparatus 10 comprises a blanket 11 and a pocket 20 held together along the side and bottom edges of the pocket. In the preferred embodiment, the blanket 11 and pocket 20 are removably attached to each other by paired fasteners 12, 13 which are strips of VELCRO® or of other tape having intermeshing faces which can be fastened to each other. Alternately, the side and bottom edges of the pocket 20 can be sewed or fastened with snaps, zippers or the like to the blanket 11.

Figure 2:
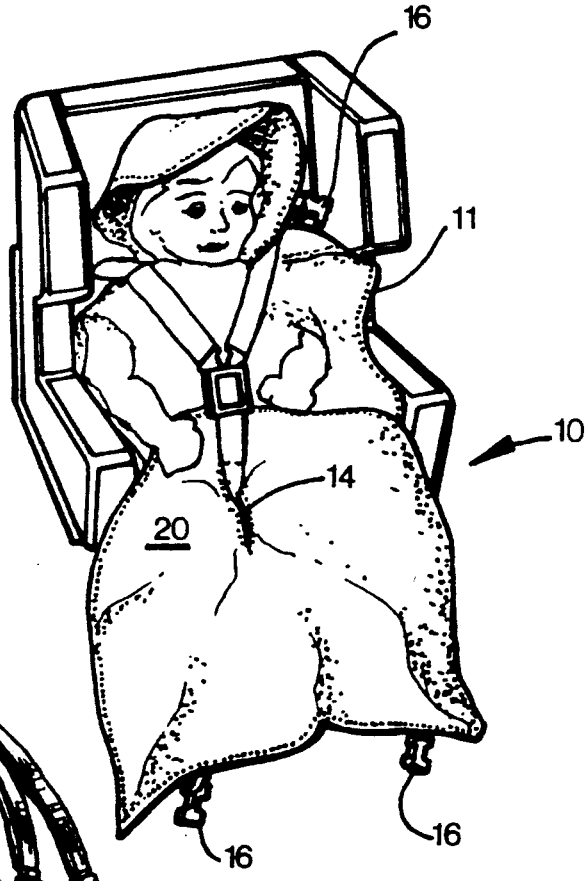
FIG. 2 is a perspective view of the multi-purpose wrap according to FIG. 1 when the wrap is used as a pad on a car seat or stroller.

For ease of use with a car seat or stroller having a safety belt which passes between the legs of the baby, the wrap 10 is slotted (FIG. 2). Specifically, the pocket 20 has individualized compartments for receiving the infant's legs, the compartments being separated by a slot 14. The slot 14 comprises an aligned pair of narrow, elongated apertures formed along the centerlines of the blanket 11 and of the pocket 20, respectively. In an alternate embodiment shown in FIG. 5, a wrap 30, otherwise virtually identical to the wrap 10, is bifurcated by a slit 34 rather than having the slot 14. The slit 34 is formed by a pair of narrow, elongated, overlapping cutouts in the blanket 31 and in the pocket 40 which extend upwardly from the bottom edges of the blanket and of the pocket, respectively.

Figure 5:
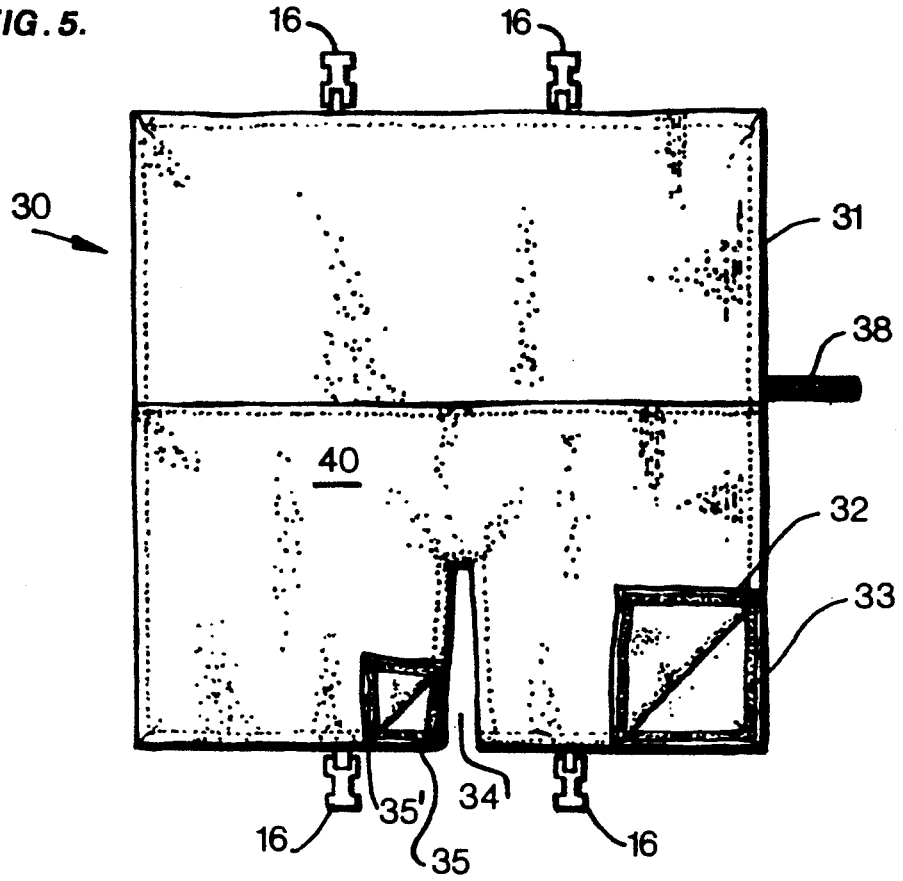
FIG. 5 shows an alternate embodiment of the multi-purpose wrap in which the pocket and blanket are bifurcated so as form a pair of legs between which a safety belt or the like can be passed.

When the blanket 11 is used as a wrap, the baby is placed feet first in the pocket 20. The left side of the blanket 11 is drawn across the baby's midriff and then the right side. A fastener strap 18, which extends outwardly from an upper edge of the pocket 20, is pulled around the baby and then secured to a strap adapter 19 which is attached to the backside of the blanket 11. In the preferred embodiment, the strap 18 includes a VELCRO® strip which intermeshes with another VELCRO® strip which comprises the adapter 19. When the strap 18 is fastened to the adapter 19 so as to secure the baby in the wrap 10, the baby can rest comfortably, snug in pocket 20, but with his arms free (FIG. 1). As an alternative to the intermeshing strap 18 and adapter 19, a pair of ties (not shown) sewn to the wrap 10 may be used and secured in a bow knot. Further, in the embodiment 30 shown in FIG. 5, the baby is placed in pocket 40 and the left side of blanket 31 is pulled across the baby and then the right side and secured by strap 38 to an adapter on the backside of the blanket (not shown). The pocket 40 is held in place on the blanket 31 by intermeshing VELCRO® strips 32 and 33; 35 and 35' (FIG. 5).

Figure 3:
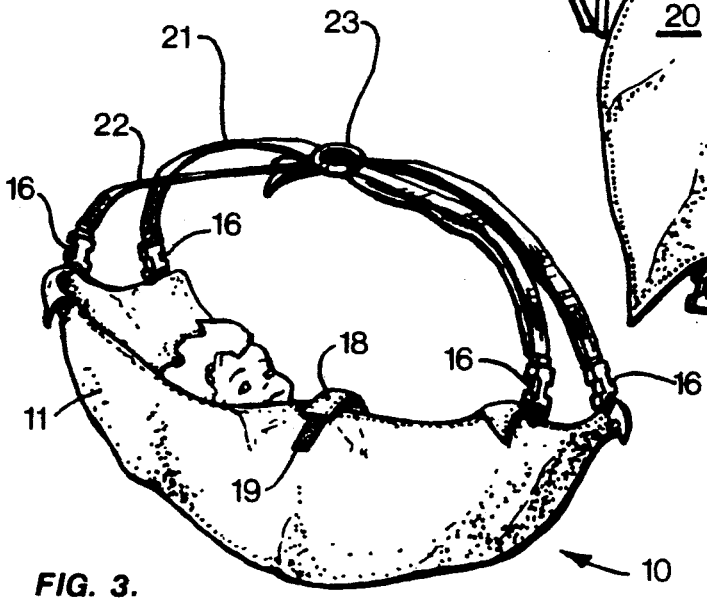
FIG. 3 is a perspective view of the multi-purpose wrap according to FIG. 1 when the wrap is used in the bunting configuration as a sling carrier.
Figure 4:
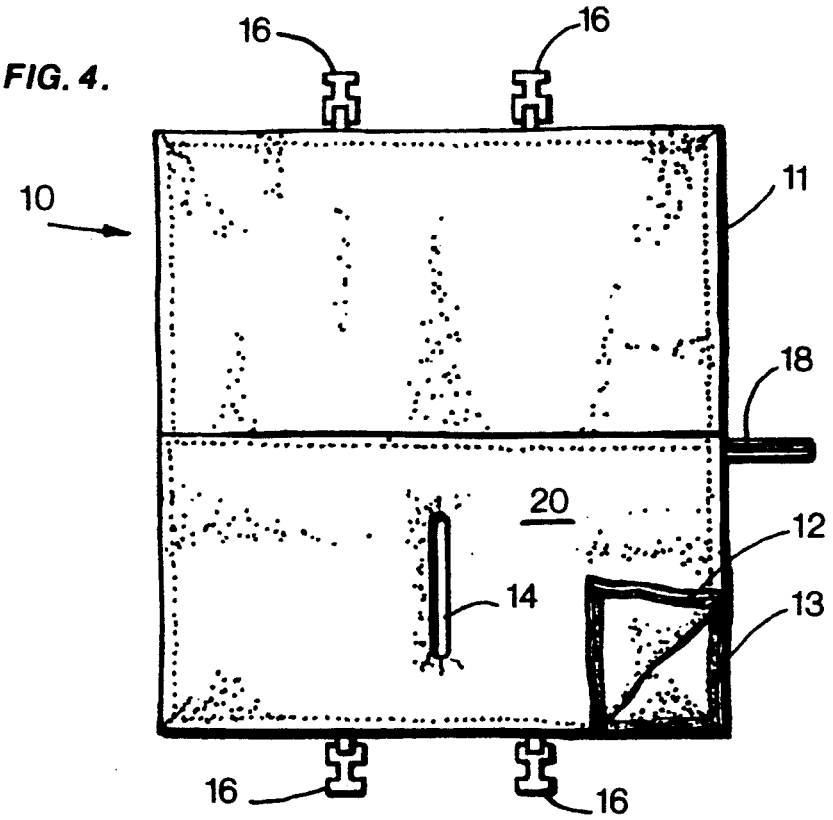
FIG. 4 is a plan view of the multi-purpose wrap according to FIG. 1 in which a section of the pocket has been folded back to show a portion of the interlocking faces of VELCRO® or like fastener on the pocket and blanket.

In order to provide hands-free holding of the baby, the wrap 10 may be converted to a sling as illustrated in FIG. 3. Two pairs of devices 16 to which straps 21, 22 can be detachably connected are provided. In the preferred embodiment, each of the devices 16 is a first part of a mating connector, the first part being capable of receiving a second part (not shown) of the connector attached to the end of a strap 21, 22. The devices 16 are secured to the wrap 10 at spaced intervals along the top and bottom edges of the blanket 11 as shown in FIGS. 4 and 5. When the wrap 10 is secured by the strap 18 about the baby, the wrap 10 naturally forms corner-like folds. Each of these corner-like folds is disposed proximate with one of the devices 16. The straps 21, 22 are preferably crossed in the center when they are used as part of a sling for carrying the baby. Means including a buckle 23 attached to each strap 21, 22 for adjusting its length is also included, so that a caregiver can either carry the baby supported by her shoulder or across her body.

In the preferred embodiment, the blanket 11 and the pocket 20 are both made of a quilted material. Cotton, cotton polyester blend, and the like are the materials of choice.

It is apparent from the foregoing that a new and improved multi-purpose apparatus for infant care has been provided. While only the presently preferred embodiment of the invention has been disclosed, as will be apparent to those familiar with the art, certain changes and modifications can be made without departing from the scope of the invention as defined by the following claims.

What is claimed is:

1. A multi-purpose baby wrap adapted for a baby strapped in a car seat with a seat belt, comprising:

(a) a blanket having at least one pair of peripheral side edges which are disposed generally parallel to each other;

(b) a pocket attached to the blanket, the pocket covering about one-half of the surface area of one side of the blanket, the pocket being sized so that the baby can be placed in the pocket from its feet to the waist;

(c) means for securing the blanket with the pocket attached thereto around the midriff of the baby's body so as to overlap portions of said peripheral side edges of the blanket; and (d) means including a slot for inserting the safety belt between the baby's legs when the baby is wrapped in the blanket with said portions of the peripheral side edges overlapping, the blanket and the pocket having overlapping sections which define the slot, the slot having two ends, each end being spaced apart from any peripheral edge of the pocket proximate thereto.

2. A multi-purpose baby wrap adapted for a baby strapped in a car seat with a seat belt, comprising:

(a) a blanket having at least one pair of peripheral side edges which are disposed generally parallel to each other;

(b) a pocket attached to the blanket, the pocket covering about one-half of the surface area of one side of the blanket, the pocket being sized so that the baby can be placed in the pocket from its feet to the waist;

(c) means for securing the blanket with the pocket attached thereto around the midriff of the baby's body so as to overlap portions of said peripheral side edges of the blanket; and (d) means for inserting the safety belt between the baby's legs when the baby is wrapped in the blanket with said portions of the peripheral side edges overlapping, the pocket having a substantially straight upper edge and defining a first narrow, elongated aperture which extends generally perpendicularly to said upper edge of the pocket and the blanket defining a second narrow, elongated aperture; the first aperture having two ends, each end of the first aperture being spaced apart from any peripheral edge of the pocket proximate thereto; the first and second apertures, when aligned with each other, defining a slot for receiving the safety belt when the belt is placed between the legs of the baby.

3. A multi-purpose baby wrap according to claim 1 wherein the blanket is further characterized as having top and bottom edges, and which further comprises straps, two pairs of fasteners, and means for releasably securing the straps to the fasteners; the first pair of fasteners being spaced apart from each other and disposed along the top edge of the blanket and the second pair of fasteners being spaced apart from each other and disposed along the bottom edge of the blanket; the fasteners being disposed at corner-like folds of the wrap when the wrap is used as a sling.

4. The multi-purpose baby wrap according to claim 1 wherein the pocket and the blanket are each further characterized as having side and bottom edges and which further comprises means for attaching the pocket to the blanket, the attaching means including intermeshing faces of a Velcro-type fastener secured to the side and bottom edges of the pocket and of the blanket, respectively, so that the side and bottom edges of the pocket can be opened to allow the baby's diaper to be changed without removing the baby from the pocket.

5. The multi-purpose baby wrap according to claim 1 wherein the securing means further comprises a strap attached to the blanket and extending beyond and laterally from one of said peripheral side edges, the strap having one face of a Velcro-type fastener, and an adapter connected to the backside of the blanket, the adapter having a surface with which said face of the Velcro-type fastener on the strap can intermesh.

* * * * *